US008936476B2

(12) United States Patent
Shindo et al.

(10) Patent No.: US 8,936,476 B2
(45) Date of Patent: Jan. 20, 2015

(54) CONNECTOR INCLUDING LOCKING STRUCTURE HAVING A LOCKING LUG AND A SPRING PORTION

(71) Applicant: Japan Aviation Electronics Industry, Limited, Tokyo (JP)

(72) Inventors: Jun Shindo, Tokyo (JP); Takahiro Yamaji, Tokyo (JP); Kazuaki Ibaraki, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 42 days.

(21) Appl. No.: 13/684,873

(22) Filed: Nov. 26, 2012

(65) Prior Publication Data

US 2013/0137284 A1 May 30, 2013

(30) Foreign Application Priority Data

Nov. 28, 2011 (JP) ..... 2011-259404

(51) Int. Cl.
*H01R 13/62* (2006.01)
*H01R 12/50* (2011.01)
(Continued)

(52) U.S. Cl.
CPC ..... *H01R 23/701* (2013.01); *H01R 12/774* (2013.01); *H01R 12/79* (2013.01); *H01R 13/62994* (2013.01)
USPC ..... 439/153

(58) Field of Classification Search
USPC ..... 439/352–358, 607.01, 153, 260
See application file for complete search history.

(56) References Cited

U.S. PATENT DOCUMENTS 7,695,295 B2 4/2010 Hanyu
7,766,680 B2 * 8/2010 Suzuki et al. ..... 439/260
(Continued)

FOREIGN PATENT DOCUMENTS

CN 102057539 A 5/2011
JP 4098290 B2 3/2008
(Continued)

OTHER PUBLICATIONS

Chinese Office Action dated Aug. 27, 2014 issued in counterpart Chinese Application No. 201210496257.1.
(Continued)

*Primary Examiner* — Chandrika Prasad
(74) *Attorney, Agent, or Firm* — Holtz, Holtz, Goodman & Chick PC

(57) ABSTRACT

Provided is a connector lockable a connection with the connection object securely. The connector comprises a housing, an attachment, and a lock portion. The connection object which has a locked portion is inserted to and connected with the connector from the front of the connector. The attachment is attached to the housing and comprises an upper attachment positioned higher than the housing, a lower attachment positioned lower than the housing, and a coupling portion coupling the upper attachment and the lower attachment. The lock portion comprises a locking lug positioned backward of the coupling portion and engaging with the locked portion of the connection object when the connection object connected with the connector is moved in an eject direction opposite to the insertion direction, and a spring portion positioned between the upper attachment and the lower attachment and supporting the locking lug so as to be displaceable in a vertical direction perpendicular to the insertion direction.

11 Claims, 10 Drawing Sheets

(51) Int. Cl.

| | |
|---|---|
| ***H01R 12/77*** | (2011.01) |
| ***H01R 12/79*** | (2011.01) |
| ***H01R 13/629*** | (2006.01) |

(56) References Cited

U.S. PATENT DOCUMENTS

| | | | | |
|---|---|---|---|---|
| 7,934,957 | B1 | 5/2011 | Nakajima et al. | |
| 8,172,592 | B2 | 5/2012 | Ogura et al. | |
| 8,398,417 | B2 * | 3/2013 | Ozeki | 439/260 |
| 8,608,509 | B2 * | 12/2013 | Shimada et al. | 439/607.01 |
| 2006/0264103 | A1 | 11/2006 | Wei | |
| 2008/0261422 | A1 * | 10/2008 | Hanyu | 439/153 |
| 2012/0064749 | A1 * | 3/2012 | Hashimoto | 439/329 |
| 2012/0220171 | A1 * | 8/2012 | Shimada et al. | 439/660 |
| 2014/0057478 | A1 * | 2/2014 | Yoshisuji et al. | 439/350 |

FOREIGN PATENT DOCUMENTS

| | | | |
|---|---|---|---|
| JP | 2008-192574 | A | 8/2008 |
| JP | 2010-238512 | A | 10/2010 |
| JP | 2011-14397 | A | 1/2011 |
| JP | 2011044405 | A | 3/2011 |
| JP | 2011-159598 | A | 8/2011 |

OTHER PUBLICATIONS

Korean Office Action dated Jul. 23, 2014 issued in counterpart Korean Application No. 10-2012-0132983.

* cited by examiner

CONNECTOR INCLUDING LOCKING STRUCTURE HAVING A LOCKING LUG AND A SPRING PORTION

CROSS REFERENCE TO RELATED APPLICATIONS

Applicants claim priority under 35 U.S.C. §119 of Japanese Patent Application No. JP2011-259404 filed Nov. 28, 2011.

BACKGROUND OF THE INVENTION

The present invention relates to a connector connectable with a connection object such as a FPC (Flexible Printed Circuits) and lockable a connection between the connector and the connection object.

A connector of this type is disclosed in JP-A 2008-192574, which is incorporated herein by reference in its entirety. As shown in FIG. 19 and FIG. 20, a connector disclosed in JP-A 2008-192574 is connectable with an FPC (a connection object) which has an engaged hole. The FPC is inserted into and connected with the connector from the front of the connector in an insertion direction. The connector comprises a shell which has an engaging projection (a lock portion). In a connection state where the FPC and the connector are connected with each other, the engaging projection is positioned in the engaged hole so that the connection state between the FPC and the connector is locked. In detail, when the FPC in the connection state is pulled in a eject direction opposite to the insertion direction, the engaging projection engages with the engaged hole and, therefore, the connection state between the FPC and the connector is maintained.

According to the connector of JP-A 2008-192574, when the FPC connected with the connector is pulled by force, at least the engaged hole or the engaging projection may be damaged. When the engaged hole or the engaging projection is damaged, the connection between the FPC and the connector may be released (unlocked) so that FPC may be pulled out of the connector.

SUMMARY OF THE INVENTION

It is an object of the present invention to provide a connector having a structure which can lock the connection with the FPC securely.

One aspect of the present invention provides a connector connectable with a connection object having a locked portion, the connection object being inserted into the connector from the front of the connector in an insertion direction. The connector comprises: a housing; an attachment attached to the housing and comprising an upper attachment positioned higher than the housing, a lower attachment positioned lower than the housing, and a coupling portion coupling the upper attachment and the lower attachment; and a lock portion comprising a locking lug positioned rearward of the coupling portion and engaging with the locked portion of the connection object when the connection object connected with the connector is moved in an eject direction opposite to the insertion direction, and a spring portion positioned between the upper attachment and the lower attachment and supporting the locking lug so as to be displaceable in a vertical direction perpendicular to the insertion direction.

An appreciation of the objectives of the present invention and a more complete understanding of its structure may be had by studying the following description of the preferred embodiment and by referring to the accompanying drawings.

Figure 1:
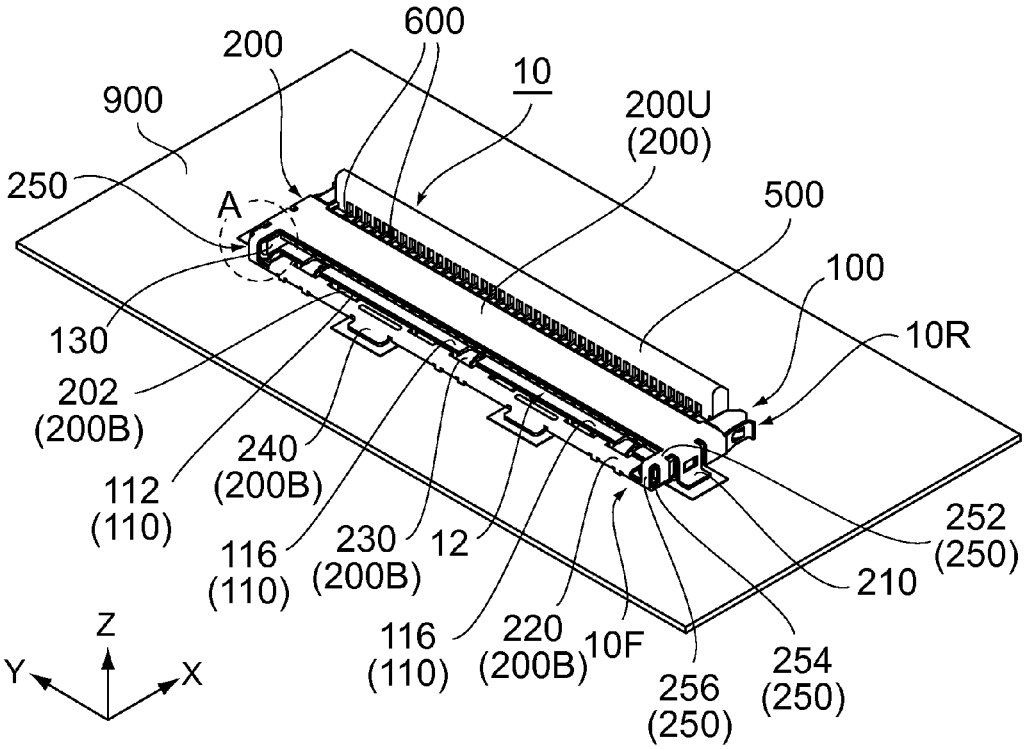
FIG. 1 is an oblique view showing a connector according to the embodiment of the present invention. An actuator of the connector is positioned at an open position.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 4:
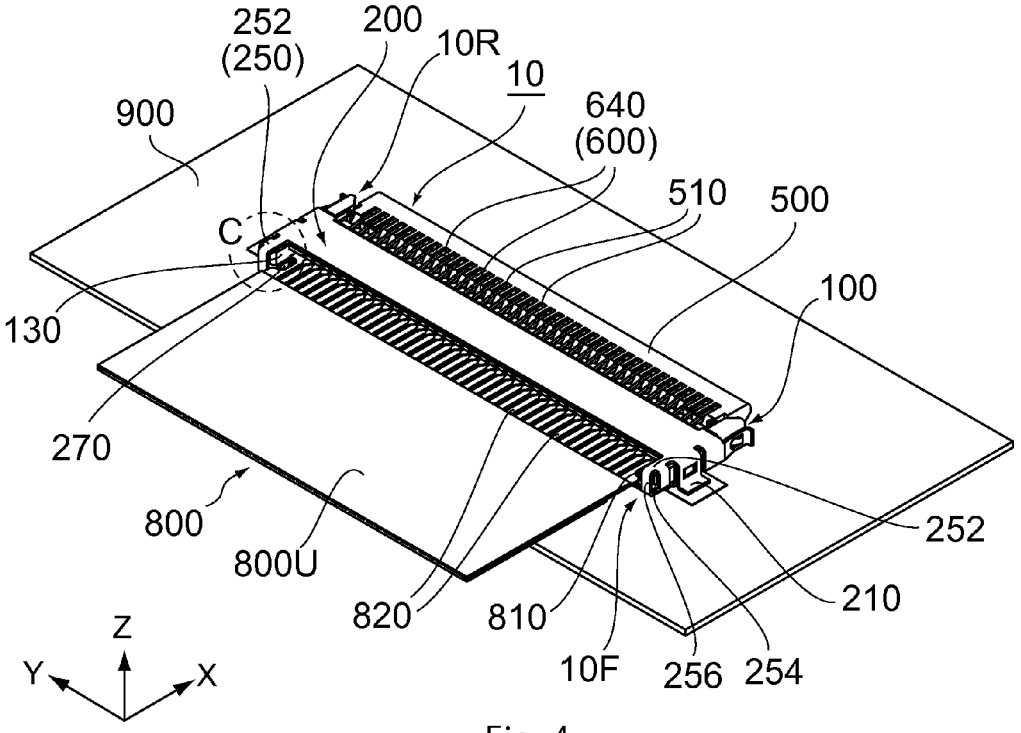
FIG. 4 is an oblique view showing the connector of FIG. 1. An FPC (a connection object) is inserted to and connected with the connector. The actuator is positioned at a close position.

As shown in FIG. 1 and FIG. 4, a connector 10 of the embodiment is configured to be mounted and fixed to a mount object (for example, a circuit board 900). The connector 10 is connectable with an FPC (a connection object) 800 in a state where the connector 10 is mounted on the circuit board 900.

The connector 10 is a low-profile connector which has a thin plate like shape in the vertical direction (in a Z direction) and extends in a width direction (in a Y direction) perpendicular to the vertical direction. The connector 10 has a front end 10F and a rear end 10R in an insertion direction and an eject direction (in a X direction), wherein the front end 10F is an end portion in a −X direction while the rear end 10R is an end portion in a +X direction.

Figure 3:
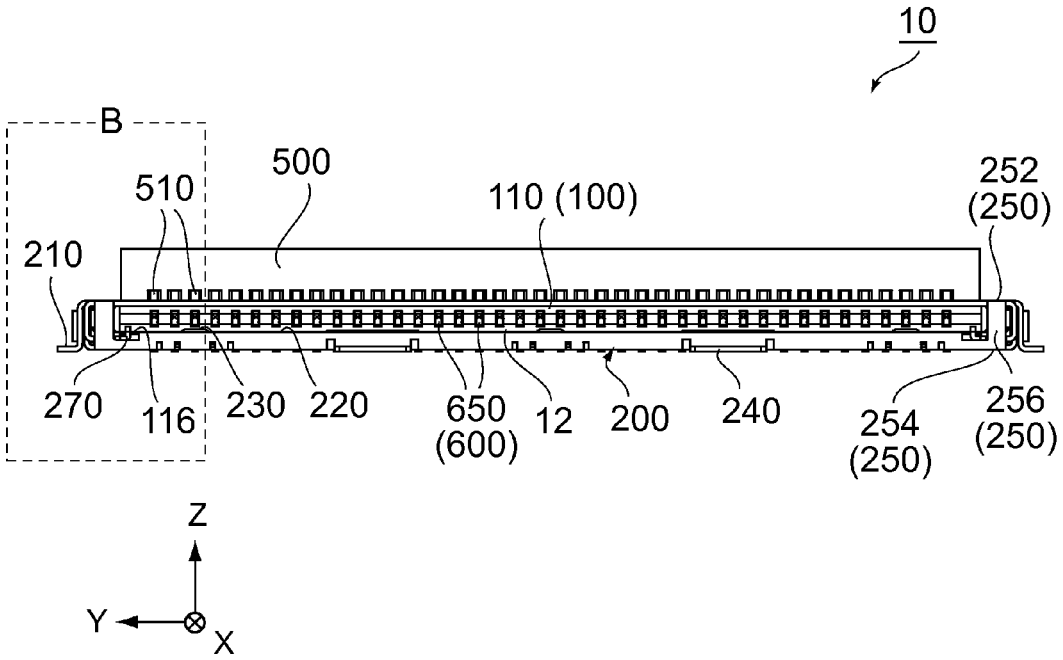
FIG. 3 is a front view showing the connector of FIG. 1.

As understood from FIG. 1, FIG. 3 and FIG. 4, the connector 10 comprises an insertion opening 12. The insertion opening 12 is positioned at the front end 10F of the connector 10 and extends in the Y direction. The FPC 800 is inserted into the insertion opening 12 in the insertion direction (in the +X direction) and is connected with the connector 10. The FPC 800 connected with the connector 10 is ejected from the connector 10 in the eject direction (in the −X direction).

Figure 6:
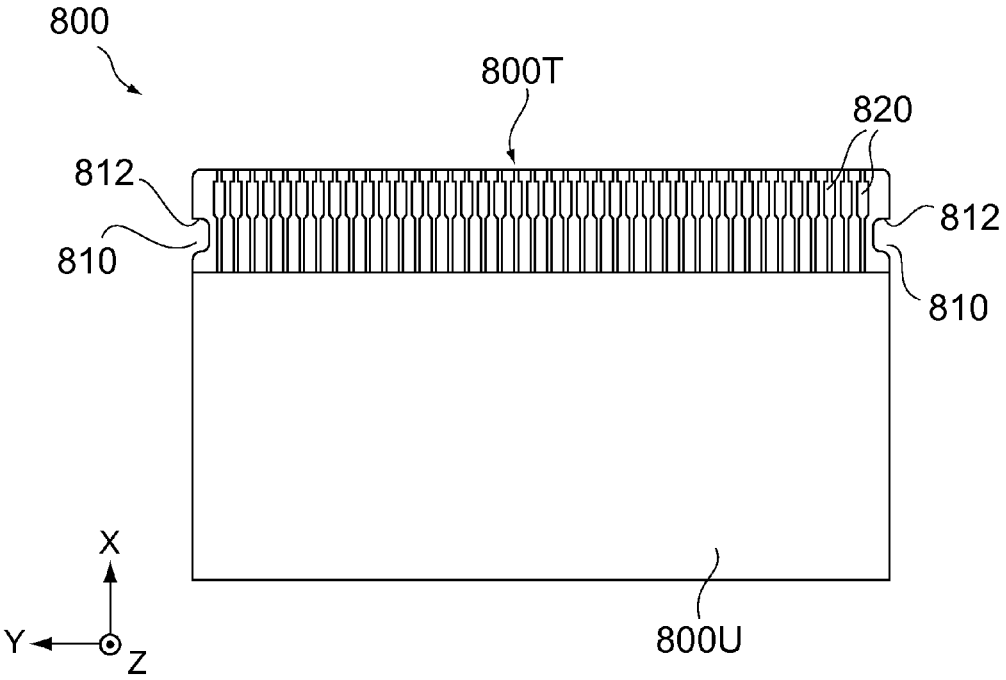
FIG. 6 is a plan view showing the FPC to be inserted to and connected with the connector of the embodiment.
Figure 7:
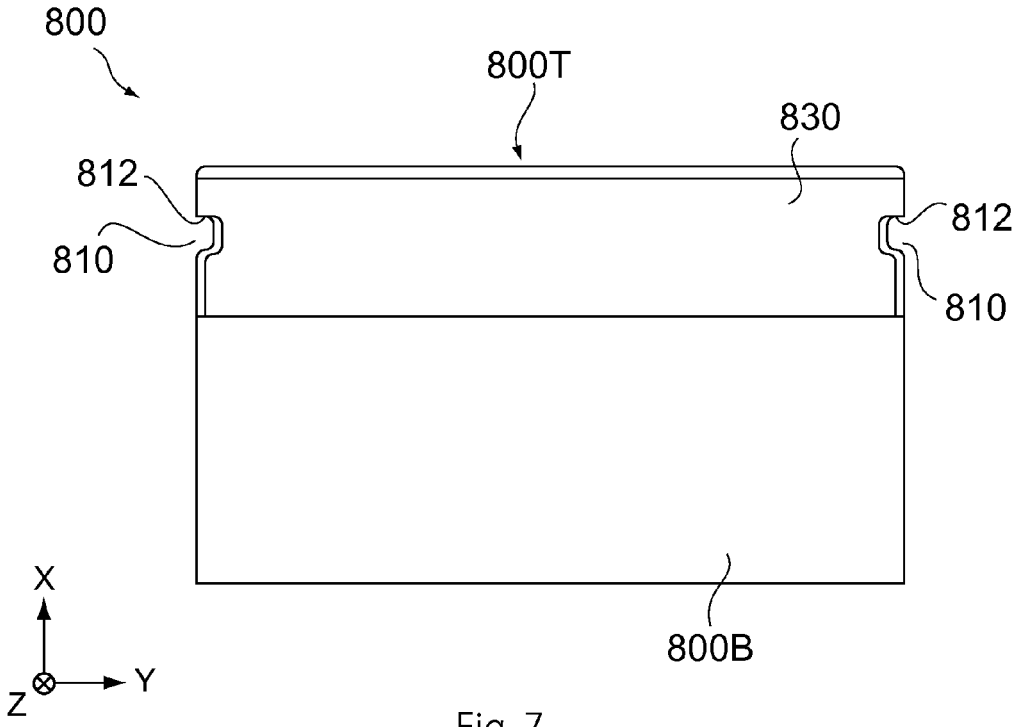
FIG. 7 is a bottom view showing the FPC of FIG. 6.

As shown in FIG. 6 and FIG. 7, the FPC 800 has a rectangular sheet like shape and is brought in parallel with an XY surface before being inserted to the insertion opening 12. The FPC 800 has a top end 800T positioned at the end of the FPC 800 in the +X direction, an upper surface (a signal surface) 800U positioned at the upper side of the FPC 800 in the +Z direction, and a bottom surface 800B (a ground surface) positioned at the bottom side of the FPC 800 in the −Z direction. The top end 800T extends in the Y direction.

The FPC 800 comprises a plurality of signal contacts 820 and a ground contact 830. The signal contacts 820 are arranged in the Y direction so that spaces between each of the neighboring signal contacts 820 are the same and that the signal contacts 820 are exposed at the upper surface 800U in the vicinity of the top end 800T. The ground contact 830 extends in the Y direction and is exposed at the bottom surface 800B in the vicinity of the top end 800T.

Figure 12:
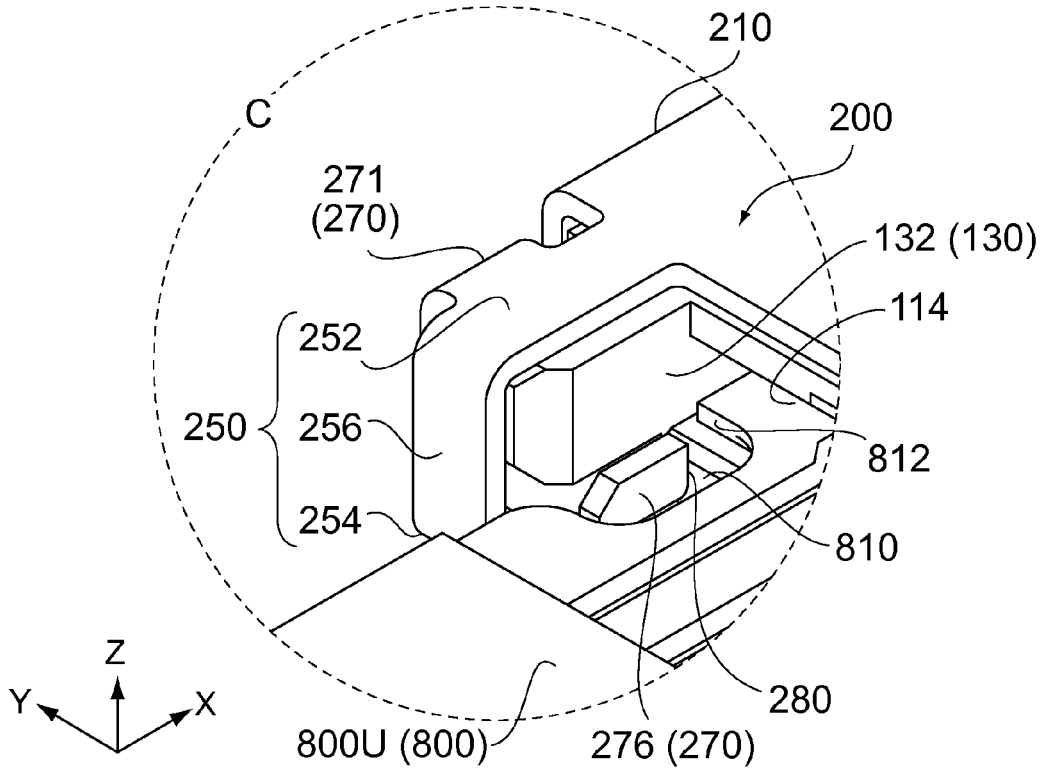
FIG. 12 is an enlarged partial oblique view showing the attachment and the lock portion (i.e. an area "C" enclosed with a dashed line in FIG. 4) of the connector of FIG. 4.

As shown in FIG. 6, FIG. 7 and FIG. 12, the FPC 800 comprises two locked portions 810. The locked portions 810 are formed on both sides of the FPC 800 in the Y direction. Each of the locked portions 810 is recessed inward of the FPC 800 in the Y direction. However, the shapes of the locked portions 810 are not limited thereto. The locked portions 810 may project outward of the FPC 800. The locked portions 810 may be holes formed on the FPC 800. The locked portions 810 are formed with engaged portions 812. Each of the engaged portions 812 has a surface perpendicular to the X direction.

Figure 2:
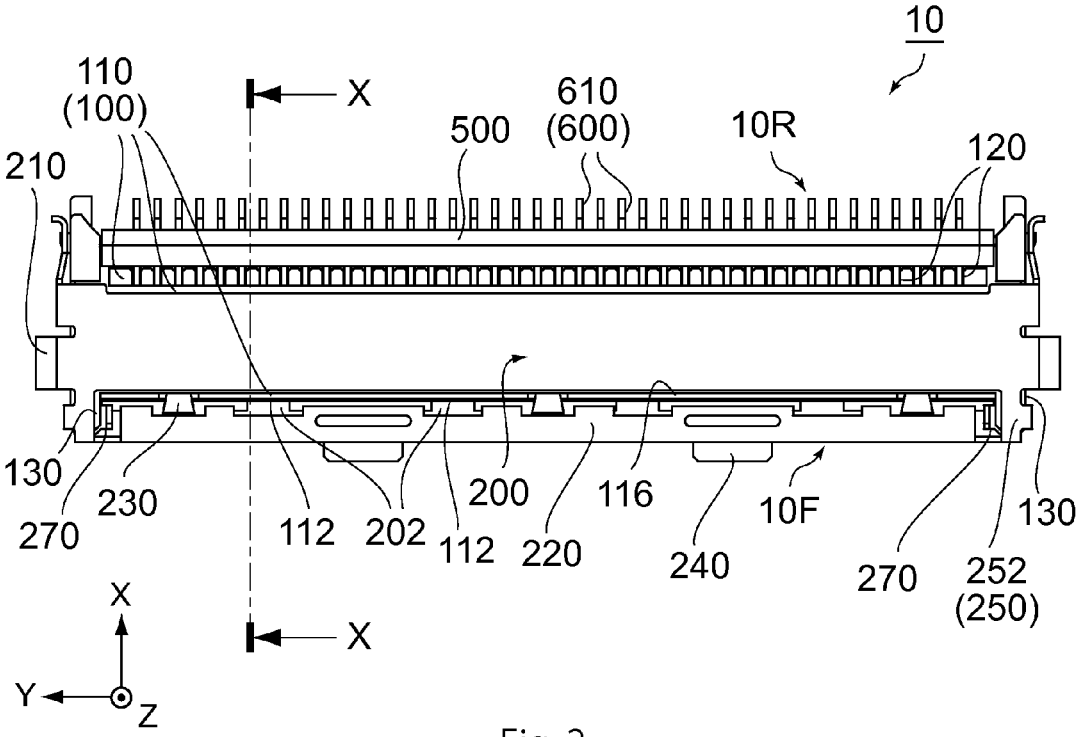
FIG. 2 is a plan view showing the connector of FIG. 1.

As shown in FIG. 1 to FIG. 3, the connector 10 comprises a housing 100 made of insulative material, a shell 200 made of metal, an actuator 500 made of insulative material, and a plurality of contacts 600.

As shown in FIG. 1, FIG. 2, and FIG. 10 to FIG. 12, the housing 100 comprises a body portion 110. The body portion 110 has a thin plate like shape in the Z direction and extends in the Y direction. The housing 100 comprises two arms 130 which guide the FPC 800 when the FPC 800 is inserted to the connector 10. The arms 130 are formed on both sides of the body portion 110 in the Y direction.

Figure 10:
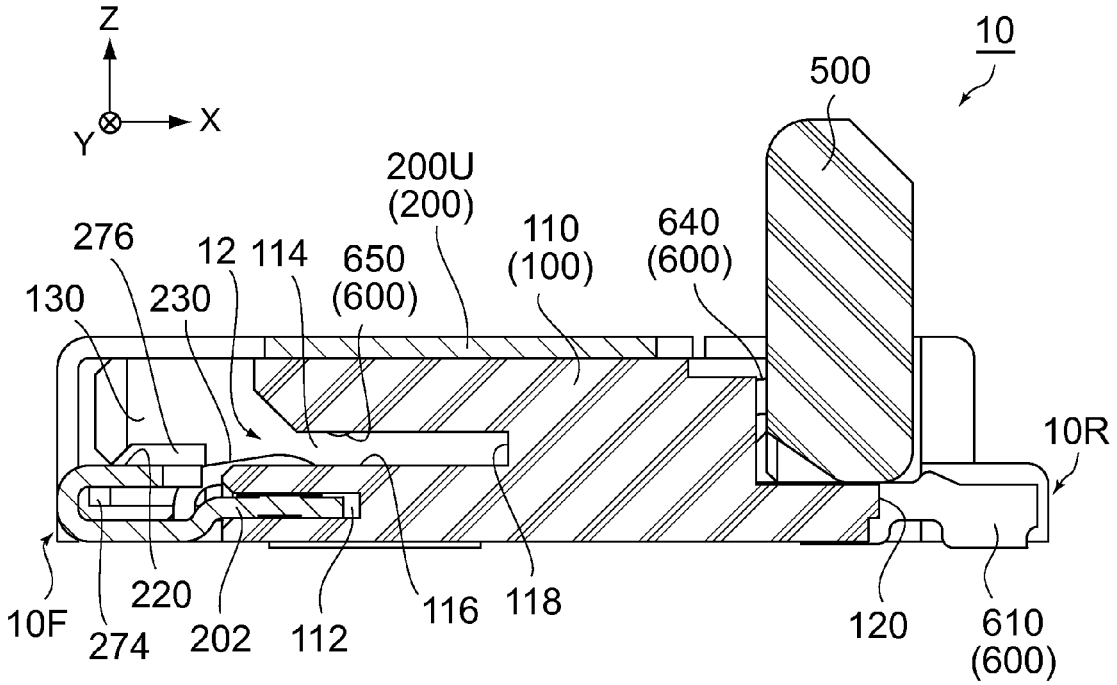
FIG. 10 is a cross-sectional view showing the connector of FIG. 2, taking along line X-X.
Figure 11:
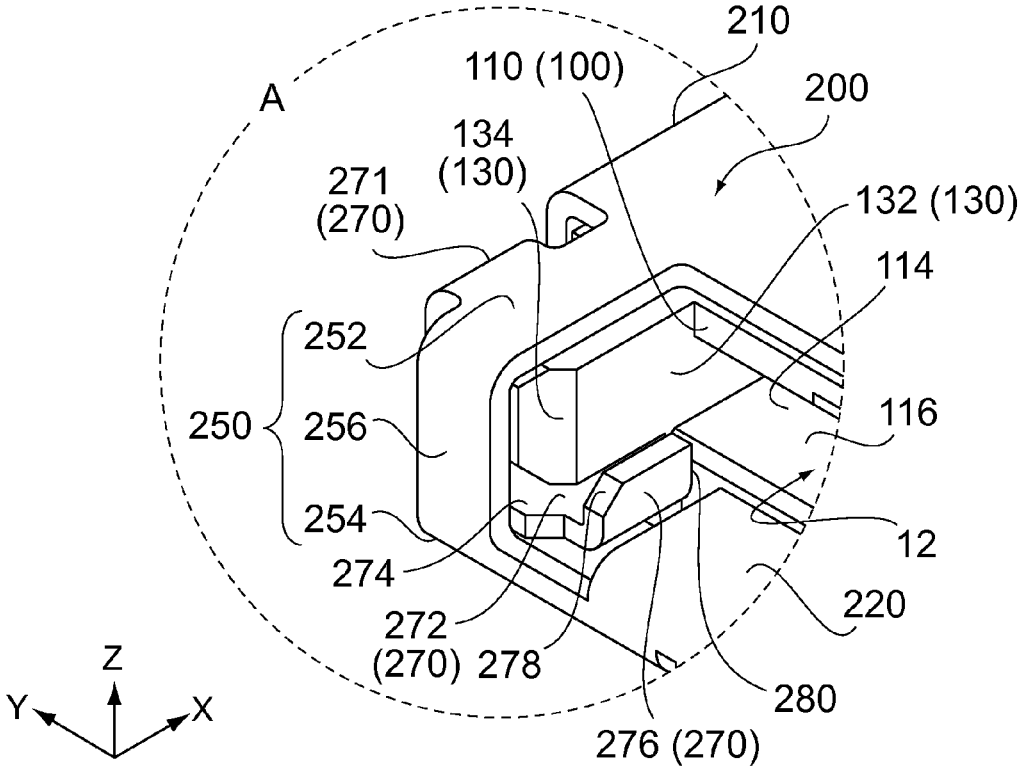
FIG. 11 is an enlarged partial oblique view showing an attachment and a lock portion (i.e. an area "A" enclosed with a dashed line in FIG. 1) of the connector of FIG. 1.

As shown in FIG. 10 to FIG. 12, the arms 130 extend forward (i.e. in the −X direction) from the body portion 110. Each of the arms 130 has an inner side and an outer side in the Y direction. The inner side of the arm 130 is formed with a guide surface 132 in parallel with an XZ surface. A distance between the guide surfaces 132 in the Y direction is substantially equal to a width of the FPC 800 (see FIG. 5). Each of the arms 130 further comprises an oblique surface 134 oblique to the X direction and the Y direction. The oblique surface 134 is positioned on the front of the guide surface 132. In detail, the oblique surface 134 extends forward and outward in the Y direction from the guide surface 132 so that the oblique surface 134 can guide the FPC 800 to the insertion opening 12.

As understood from FIG. 10 to FIG. 13, the body portion 110 of the housing 100 has an inserted portion (a receiving space) 114 into which the FPC 800 is inserted. The inserted portion 114 is a recess portion recessed rearward and extends between the guide surfaces 132 in the Y direction. The inserted portion 114 communicates with the insertion opening 12 in the −X direction and extends toward the center of the body portion 110 in the +X direction.

As show in FIG. 10 to FIG. 12, the body portion 110 further comprises a bottom portion 116 and an abutment portion 118. The bottom portion 116 of the embodiment has a surface in parallel with the XY surface. The bottom portion 116 defines the bottom of the inserted portion 114. The inserted and connected FPC 800 is arranged on the bottom portion 116. The abutment portion 118 has a surface perpendicular to the X direction and is formed at the rear end portion of the inserted portion 114 (i.e. at the rear end portion of the bottom portion 116).

As understood from FIG. 2, FIG. 10, FIG. 14 and FIG. 17, the body portion 110 of the housing 100 is formed with a plurality of contact accommodation portions 120 and a plurality of holding portions 122. The contacts 600 correspond to the contact accommodation portions 120 and the holding portions 122.

Figure 13:
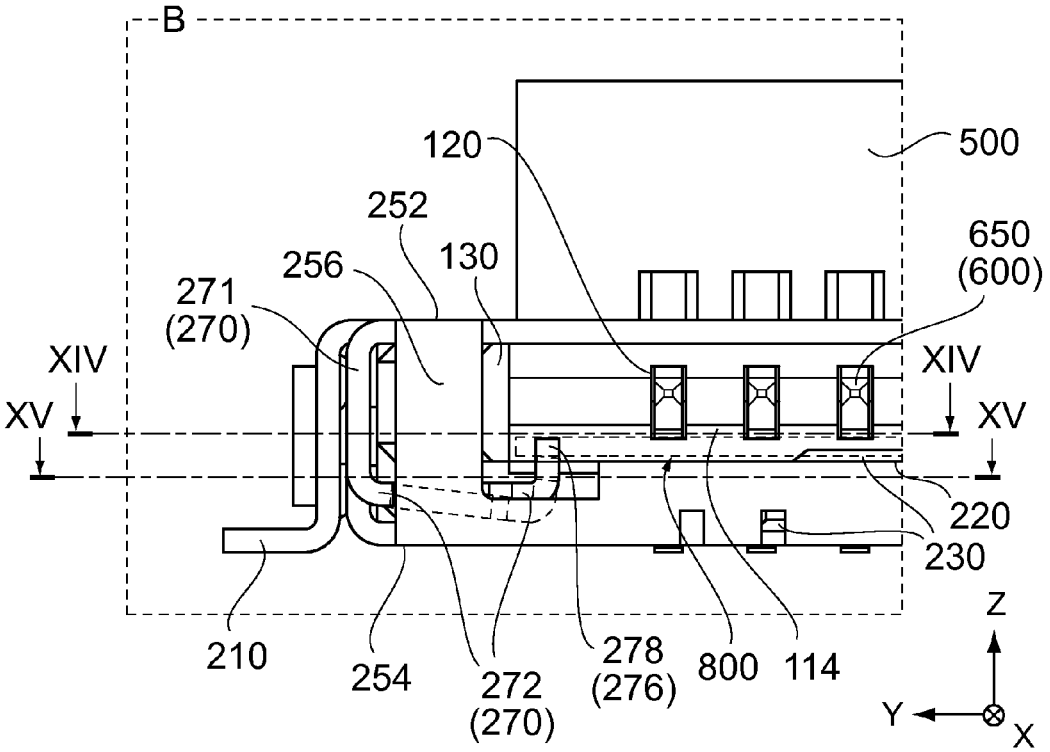
FIG. 13 is an enlarged partial oblique view showing the attachment and the lock portion (i.e. an area "B" enclosed with a dashed line in FIG. 3) of the connector of FIG. 3. The FPC and the lock portion are illustrated with dashed lines. The lock portion is displaced downward by the inserted FPC.
Figure 14:
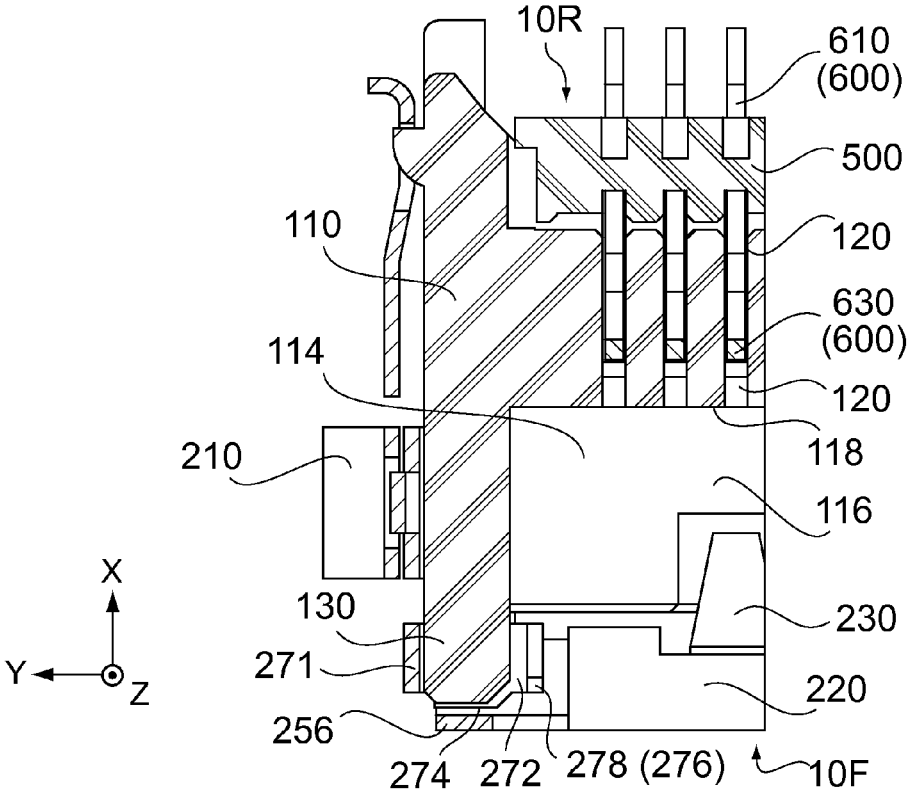
FIG. 14 is a cross-sectional view partially showing the attachment and the lock portion of FIG. 13 taking along line XIV-XIV.
Figure 17:
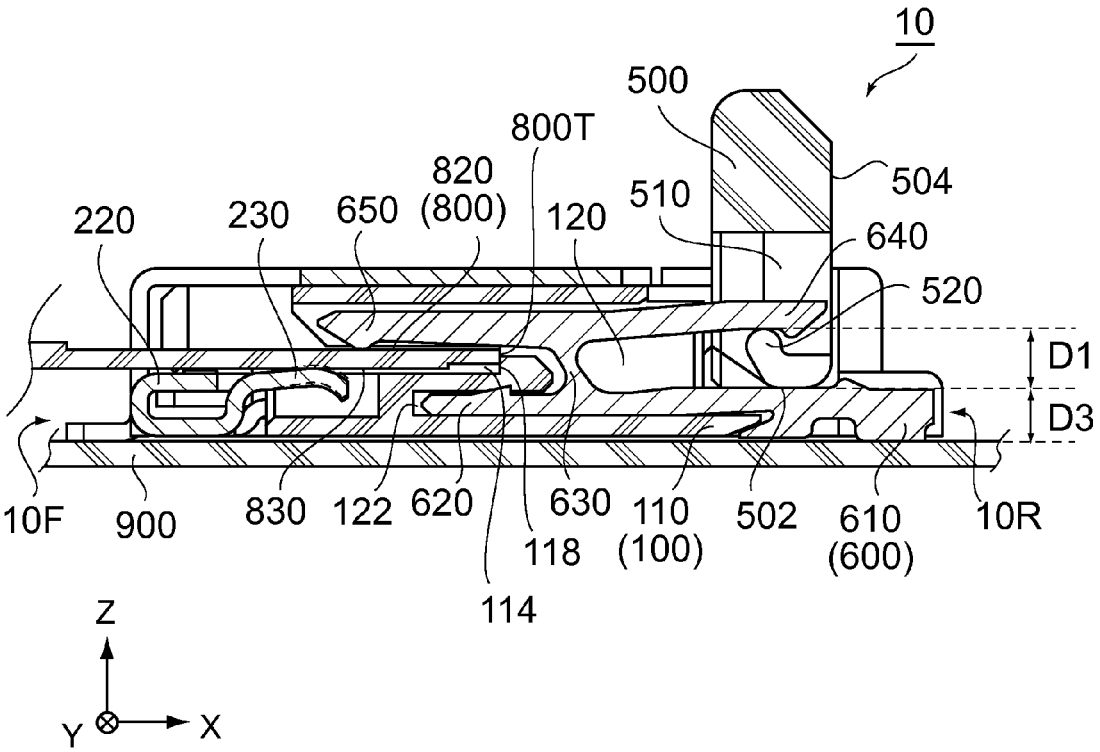
FIG. 17 is a cross-sectional view showing the connector of FIG. 5, taking along XVII-XVII. A ground spring portion before being displaced downward is illustrated with a dashed line.

As understood from FIG. 13, FIG. 14 and FIG. 17, the contact accommodation portion 120 extends in the body portion 110 in the X direction. In detail, a rear part of the contact accommodation portion 120 opens at the rear end 10R of the connector 10 while the front portion of the contact accommodation portion 120 opens at the front end 10F of the connector 10. The front part of the contact accommodation portion 120 communicates with the inserted portion 114.

As shown in FIG. 17, the holding portion 122 is a recess (a hole) extending in the body portion 110 in the X direction. The holding portion 122 communicates with a bottom part of the contact accommodation portion 120 in the X direction. The contact 600 is inserted from the rear end 10R of the connector 10 and accommodated in the contact accommodation portion 120 and the holding portion 122 so that the contact 600 is fixed to the housing 100.

As shown in FIG. 17, the contact 600 of the embodiment comprises a fixed portion 610, the held portion 620, a connection portion 630, a supported portion 640, and a contact portion 650. The connection portion 630 is positioned at the center of the contact 600 in the X direction. In detail, the connection portion 630 connects an upper part of the contact 600 with a lower part of the contact 600 in the Z direction, wherein the lower part consists of the fixed portion 610 and held portion 620, and the upper part consists of the supported portion 640 and the contact portion 650.

The fixed portion 610 is fixed to the circuit board 900 by soldering or the like. The held portion 620 is press-fitted into the holding portion 122 so that the contact 600 is held by the housing 100. The contact portion 650 extends forward (in the −X direction) from the connection portion 630. The supported portion 640 extends rearward (in the +X direction) from the connection portion 630. The supported portion 640 and the contact portion 650 are supported by the connection portion 630 so as to be displaceable in the Z direction. When the supported portion 640 is displaced upward (in the +Z direction), the contact portion 650 is displaced downward (in the −Z direction).

As shown in FIG. 10, FIG. 13 and FIG. 17, the contact portion 650 extends through the contact accommodation portion 120 and above the inserted portion 114. When seen along the +X direction, the front end of the contact portion 650 is visible. A part of the front end of the contact portion 650 (in detail, the lower end of the front end) project into the inserted portion 114.

Figure 18:
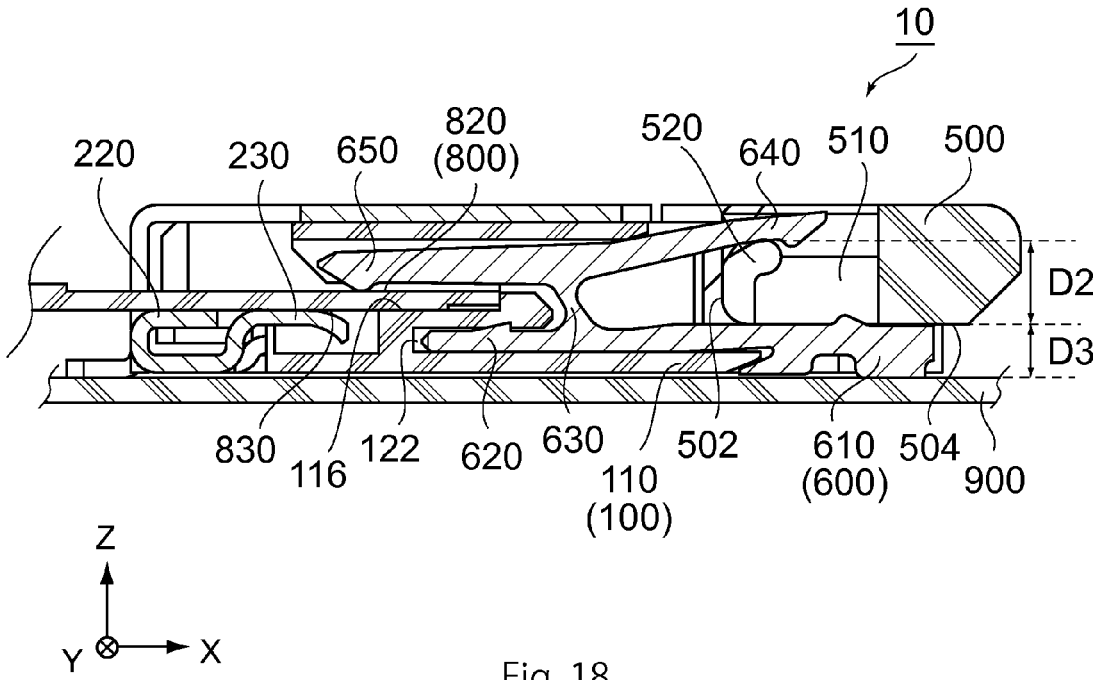
FIG. 18 is a cross-sectional view showing the connector of FIG. 5, taking along XVIII-XVIII. The actuator is rotated from the open position to the close position. The FPC is connected with connector.
Figure 19:
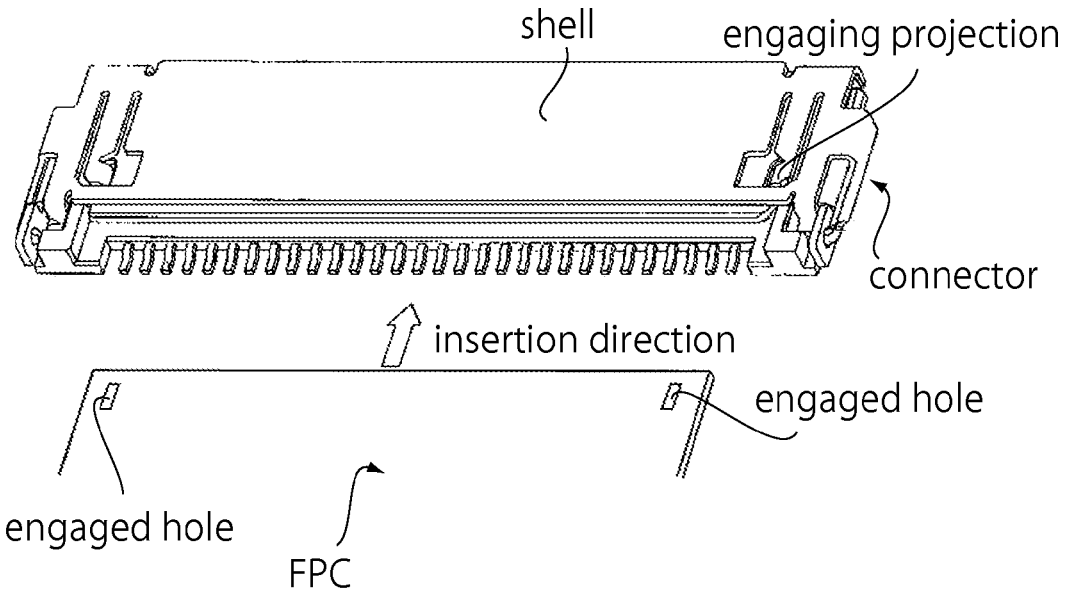
FIG. 19 is an oblique view showing an example of a conventional connector and an FPC inserted to the conventional connector.
Figure 20:
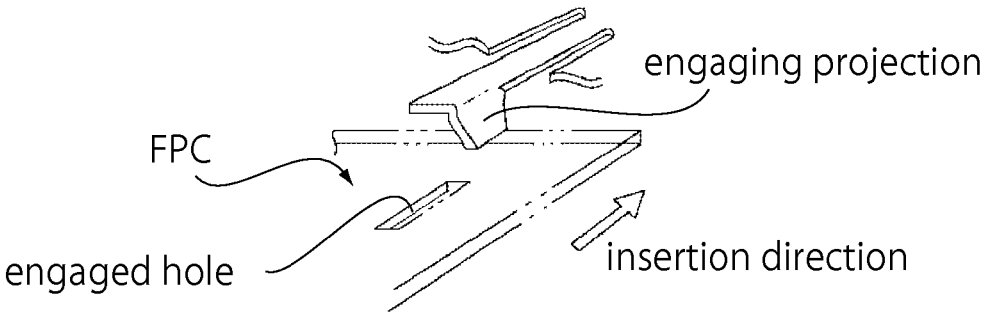
FIG. 20 is an enlarged partial oblique view showing a engaging projection of the conventional connector of FIG. 19.

As understood from FIG. 1 to FIG. 4, the actuator 500 has a plate-like shape extending in the Y direction. The actuator 500 is attached to the housing 100 from the rear end 10R of the connector 10 and is supported by the housing 100 so that the actuator 500 is rotatable between an open position (FIG. 17) and a close position (FIG. 18). The actuator 500 is formed with a plurality of supporting holes 510 penetrating the actuator 500. The supporting holes 510 correspond to the contacts 600.

As shown FIG. 17 and FIG. 18, a support portion 520 is formed in the supporting hole 510. The supported portion 640 of the contact 600 extends in the supporting hole 510 and is supported by the support portion 520 so as to be displaceable in the Z direction. In other words, supported portion 640 is always brought into contact with the upper end (i.e. the end portion in the +Z direction) of the support portion 520.

The actuator 500 has a first reference surface 502 and a second reference surface 504. The first reference surface 502 is a bottom surface of the actuator 500 positioned at the open position. The second reference surface 504 is a bottom surface of the actuator 500 positioned at the close position. As shown in FIG. 17 and FIG. 18, a distance D3 (in FIG. 17) between the first reference surface 502 and the circuit board 900 is equal to another distance D3 (in FIG. 18) between the second reference surface 504 and the circuit board 900. On the other hand, a distance D1 (in FIG. 17) between the upper portion of the support portion 520 and the first reference surface 502 when the actuator 500 is positioned at the open position is shorter than another distance D2 (in FIG. 18) between the upper portion of the support portion 520 and the second reference surface 504 when the actuator 500 is positioned at the close position. In other words, a distance D3+D1 (in FIG. 17) between the upper portion of the support portion 520 and the circuit board 900 when the actuator 500 is positioned at the open position is shorter than another distance D3+D2 (in FIG. 18) between the upper portion of the support portion 520 and the circuit board 900.

As understood from FIG. 1, FIG. 2, FIG. 8 and FIG. 9, the shell 200 is attached to the housing 100 so as to partially cover the housing 100. The shell 200 has an upper shell 200U and a bottom shell 200B. The upper shell 200U covers the upper surface (a surface in the +Z direction) of the housing 100. The bottom shell 200B is positioned under the connector 10.

Figure 8:
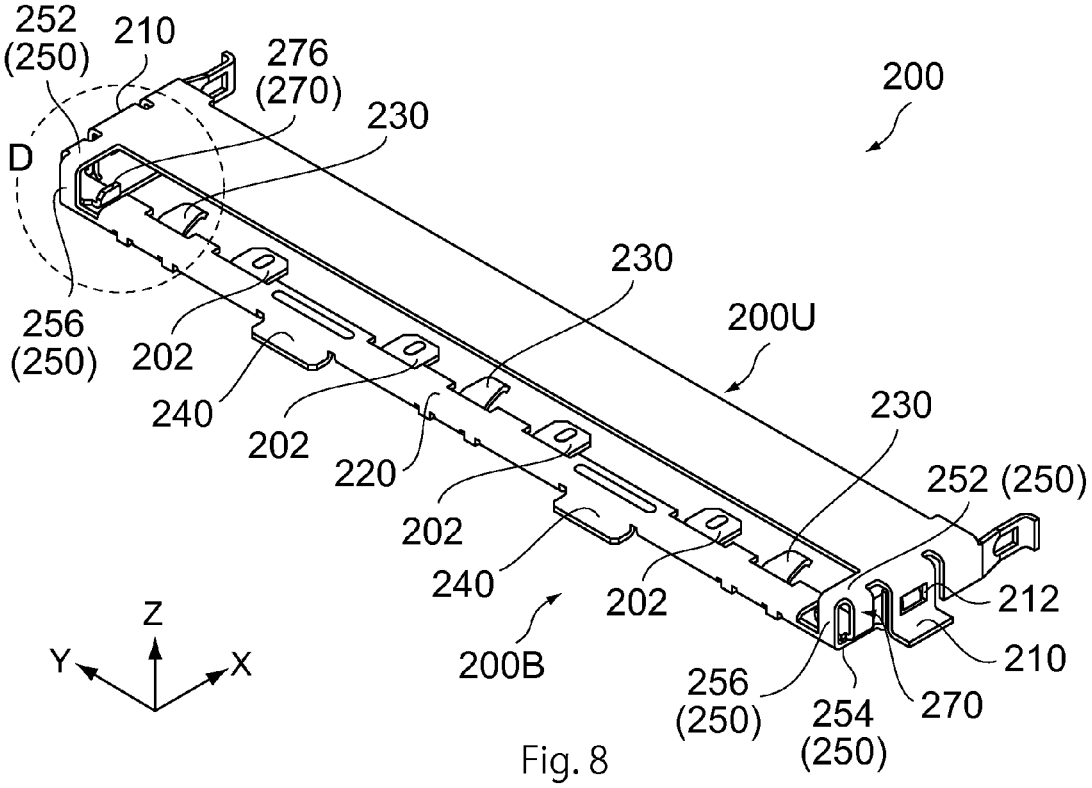
FIG. 8 is an oblique view showing a shell of the connector of FIG. 1.
Figure 9:
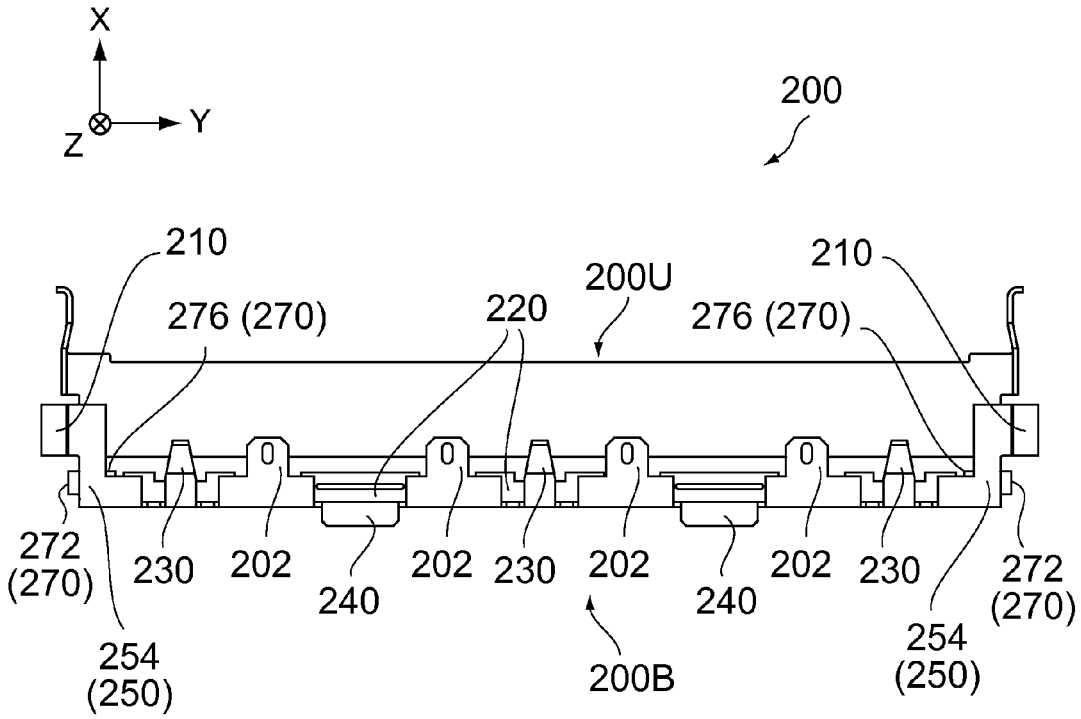
FIG. 9 is a bottom view showing the shell of FIG. 8.

As understood from FIG. 8 and FIG. 9, the shell 200 of the embodiment is formed by cutting (stamping) and bending a metal sheet so that the shell 200 has the bottom shell 200B and the upper shell 200U having a plate-like shape. In detail, the shell 200 has a bent portion in the −X direction so that the upper shell 200U is higher than the bottom shell 200B in the Z direction and that the bottom shell 200B is positioned forward (in the −X direction) from the upper shell 200U. In other words, when seen along the +Y direction, the upper shell 200U, the bent portion, the bottom shell 200B constitute a rectangular C-like shape. The bottom shell 200B has an upper portion and a bottom portion facing the upper portion. Each of the upper portion and the bottom portion is perpendicular to the Z direction.

As shown in FIG. 8 and FIG. 9, the shell 200 of the embodiment has four press-fit portions 202 formed on the bottom portion of the bottom shell 200B. Each of the press-fit portions 202 is in parallel with the XY surface and extends rearward (in the +X direction) from the bottom portion of the bottom shell 200B.

As understood from FIG. 1, FIG. 2 and FIG. 10, the housing 100 is provided with four press-fitted portions 112 corresponding to the press-fit portions 202 of the shell 200. The press-fitted portion 112 of the embodiment is a hole formed on the housing 100. Each of the press-fitted portion 112 opens forward (in the −X direction) and extends rearward (in the +X direction) in parallel with the XY surface. The shell 200 is attached to the housing 100 from the front of the housing 100 so that the press-fit portions 202 are press-fitted into the press-fitted portions 112.

As shown in FIG. 8 and FIG. 9, the shell 200 of the embodiment comprises two hold downs 210, a guide portion 220, three ground spring portions 230, and two ground portions 240. The hold downs 210 are formed at both ends of the upper shell 200U in the Y direction and extend downward (in the −Z direction). The guide portion 220 extends in the Y direction and is formed on the upper portion of the bottom shell 200B. The ground spring portion 230 extends rearward and obliquely upward from the front end of the upper portion of the bottom shell 200B (see FIG. 16). With this structure, the ground spring portion 230 is displaceable in the Z direction. The ground portion 240 is projects downward and forward from the bottom shell 200B. The ground portion 240 is positioned between the neighboring ground spring portions 230.

As shown in FIG. 1, the bottom end of the hold down 210 is connected with and fixed to the circuit board 900 by, for example, soldering. Similarly, the bottom of the ground portion 240 is connected with and fixed to the circuit board 900 by, for example, soldering so that the shell 200 is grounded. The ground portion 240 of the embodiment is fixed to the circuit board 900 in front of the connector 10 so that the connector 10 can withstand force exerted rearward (along the +X direction) when the connector 10 is mounted on the circuit board 900.

As understood from FIG. 2, FIG. 10 to FIG. 12, the guide portion 220 is configured to guide the FPC 800 when the FPC 800 is inserted in the connector 10. The guide portion 220 is positioned in front (in the −X direction) of the insertion opening 12 and extends in the Y direction. In detail, the guide portion 220 has an upper surface in parallel with the XY surface. In the Z direction, the upper surface of the guide portion 220 is on the same level as the bottom portion 116 of the inserted portion 114 (see FIG. 10).

As shown in FIG. 10 and FIG. 13, the ground spring portion 230 is positioned at the bottom of the insertion opening 12. At least a part of the end portion of the ground spring portion 230 is positioned higher than the guide portion 220 in the Z direction.

As shown in FIG. 1, the connector 10 comprises two attachments 250. The attachments 250 are attached to the both sides of the housing 100 in the Y direction.

As shown in FIG. 1. FIG. 8 and FIG. 9, the attachment 250 of the embodiment is a part of the shell 200. In detail, the attachments 250 are positioned on both end portions of the shell 200 in the Y direction. However, the attachments 250 may be separated from the shell 200 unless the attachments 250 move in the X direction.

As shown in FIG. 11 to FIG. 13, the attachment 250 has an upper attachment 252, a lower attachment 254, and a coupling portion 256. The upper attachment 252 is positioned higher than the housing 100 while the lower attachment 254 is positioned lower than the housing 100. Each of the upper attachment 252 and the lower attachment 254 has a plate-like shape in parallel with XY surface. The most part of the arms 130 of the housing 100 are covered with the upper attachment 252 and the lower attachment 254. In detail, the upper attachment 252 is a part of the upper shell 200U and covers the upper surface of the arm 130 (i.e. the upper surface of the housing 100). The lower attachment 254 is a part of the bottom shell 200B and covers the bottom surface of the arm 130. The coupling portion 256 is positioned in front of the arm 130 and extends in the Z direction. The coupling portion 256 couples the upper attachment 252 with the lower attachment 254.

As shown in FIG. 8 and FIG. 9, according to the embodiment, the coupling portion 256 of the attachment 250 couples the upper shell 200U and the bottom shell 200B. The hold down 210 of the embodiment has an engaged hole 212. The end portion of the lower attachment 254 in the +X direction extends in the +X direction and is inserted into the engaged hole 212 of the hold down 210. In other words, the upper portion and the lower portion of the coupling portion 256 are fixed to the upper attachment 252 and the lower attachment 254, respectively. Therefore, the coupling portion 256 can securely receive and withstand force exerted along the −X direction As shown in FIG. 2, the connecter 10 further comprises two lock portions 270. The lock portions 270 are provided on both end portions of the housing 100 in the Y direction.

As shown in FIG. 2, FIG. 8 and FIG. 9, the lock portion 270 of the embodiment is a part of the shell 200. In detail, the lock portion 270 is a part of the end portion of the shell 200 in the Y direction. In other words, the attachment 250 and the lock portion 270 are formed integrally with each other. However, the attachment 250 may be separated from the lock portion 270. In this case, an end portion of a spring support portion 271 is held by the housing 100.

As shown in FIG. 11 to FIG. 16, the lock portion 270 has the spring support portion 271, a spring portion 272, and a locking lug 276. The spring support portion 271 extends downward from the end portion of the shell 200 (i.e. the upper attachment 252) and covers the outer side of the arm 130. In other words, the bottom part of the spring support portion 271 is positioned lower than the arm 130 in the Z direction. The spring portion 272 is extend inward in the Y direction from the bottom end (i.e. the end portion in the −Z direction) of the spring support portion 271 so that the spring portion 272 is positioned between the arm 130 and the lower attachment 254 in the Z direction. In other words, the spring portion 272 is positioned between the upper attachment 252 and the lower attachment 254. The locking lug 276 projects upward from the end portion of the spring portion 272.

The spring portion 272 supports the locking lug 276 so as to be displaceable in the Z direction. The spring portion 272 of the embodiment extends from the spring support portion 271. The length of the spring portion 272 is long in the Y direction. Therefore, the spring portion 272 can have sufficient elastic force even if the size of the connector 10 is not enlarged.

Figure 15:
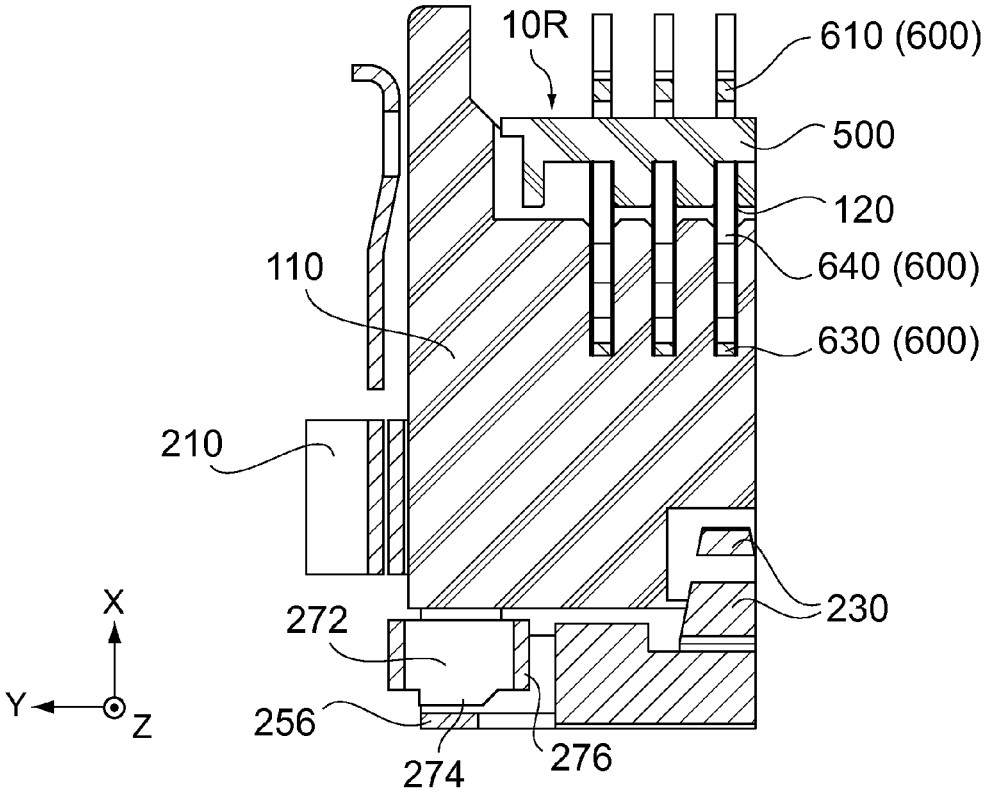
FIG. 15 is a cross-sectional view partially showing the attachment and the lock portion of FIG. 13 taking along line XV-XV.

As shown in FIG. 11, FIG. 14 and FIG. 15, the spring portion 272 has a projection portion 274 projecting toward the coupling portion 256. The front end of the projection portion 274 is close to the coupling portion 256.

Figure 16:
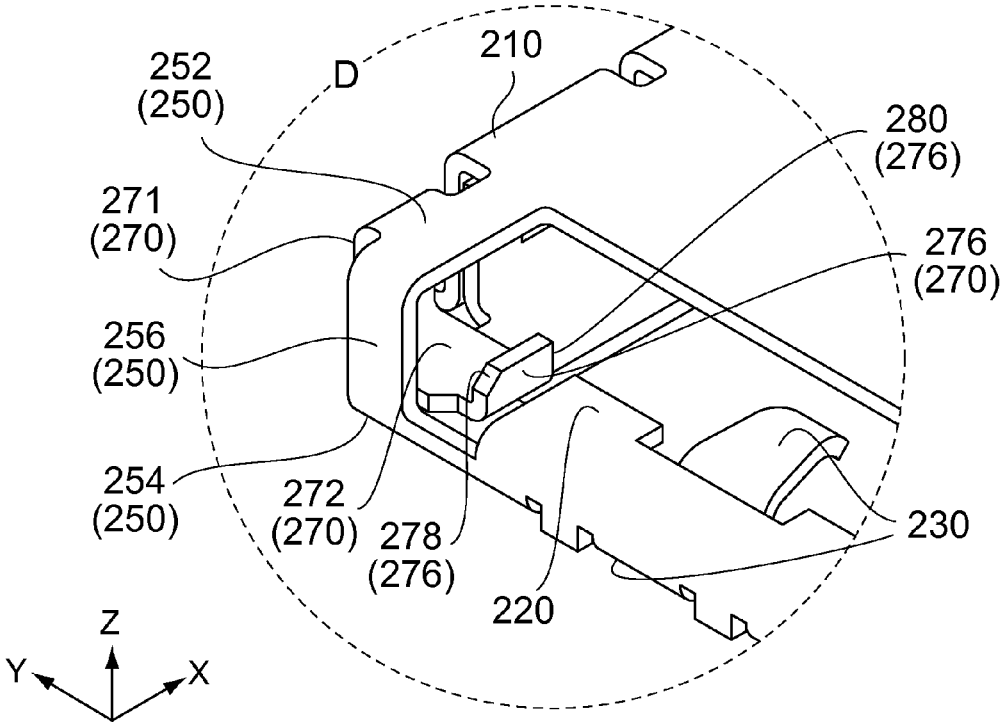
FIG. 16 is an enlarged partial oblique view showing the attachment and the lock portion (i.e. an area "D" enclosed with a dashed line in FIG. 8) of the connector of FIG. 8.

As shown in FIG. 11, FIG. 12 and FIG. 16, the locking lug 276 is in parallel with XZ surface. The locking lug 276 is formed with a force receiving portion 278 and an engagement portion 280. The force receiving portion 278 is an oblique surface formed on the front surface (in the −X direction) of the locking lug 276 and is oblique to both the X direction and the Z direction. The engagement portion 280 is a rear (in the +X direction) surface of the locking lug 276. The engagement portion 280 is perpendicular to the X direction.

As shown in FIG. 10, FIG. 11 and FIG. 13, the locking lug 276 extend upward (in the +Z direction) in the insertion opening 12 and the inserted portion 114. The end portion of the locking lug 276 is higher than the guide portion 220.

As understood from FIG. 1, FIG. 4, FIG. 11 and FIG. 12, when the actuator 500 is positioned at the open position, the FPC 800 is inserted into the inserted portion 114 through the insertion opening 12. In detail, the FPC 800 is guided by the arms 130 (the guide surfaces 132) in the Y direction and guided by the guide portion 220 in the Z direction. When the FPC 800 is inserted to the insertion opening 12, the FPC 800 pushes the ground spring portion 230 down (in the −Z direction), and the ground spring portion 230 is slightly displaced downward.

As shown in FIG. 17, the FPC 800 moves rearward in the inserted portion 114 until the top end 800T is abutted to the abutment portion 118.

As shown in FIG. 18, the actuator 500 is rotated from the open position to the close position in the state where the top end 800T of the FPC 800 is brought into contact with or close to the abutment portion 118 (see FIG. 17 and FIG. 18). With this operation, the supported portion 640 is lifted up in the +Z direction, and the contact portion 650 is displaced downward. The contact portion 650 is pushed toward the signal contact 820 of the FPC 800 so as to be electrically connected with the signal contact 820. The FPC 800 is pushed also toward the bottom portion 116 and the guide portion 220 so that the ground spring portion 230 is displaced further downward. The ground contact 830 of the FPC 800 is sandwiched between the ground spring portion 230 and the contact portion 650 and electrically connected with the ground spring portion 230. As explained above, the FPC 800 is electrically connected with the connector 10 so that the FPC 800 is electrically connected with the circuit board 900.

As described above, the ground portion 240 is arranged between neighboring ground spring portions 230 in the Y direction and positioned near the ground spring portion 230 (see FIG. 8). With this structure, the ground contact 830 of the FPC 800 is efficiently grounded.

As understood from FIG. 11 to FIG. 13, the locking lug 276 is positioned an initial position (see FIG. 11). When the FPC 800 is inserted into the inserted portion 114 and moved rearward (in the insertion direction: in the +X direction), the top end 800T (see FIG. 6) is brought into contact with the force receiving portion 278 of the locking lug 276. When the FPC 800 is moved further rearward, the force receiving portion 278 receives force exerted downward from the FPC 800 and is displaced downward from the initial position. Therefore, the top end 800T of the FPC 800 passes on the locking lug 276. When the FPC 800 is moved rearward and brought into contact with or close to the abutment portion 118 (see FIG. 17), the locking lug 276 is displaced upward and returns to the initial state (see FIG. 12).

As understood from FIG. 4, FIG. 11 and FIG. 12, the FPC 800 is inserted in and electrically connected with the connector 10 (a connection state). When the FPC 800 positioned at the connection state is moved along an eject direction (i.e. −X direction) opposite to the insertion direction, the engagement portion 280 of the locking lug 276 engages the engaged portion 812 of the FPC 800 so that and the engagement portion 280 prevents the engaged portion 812 from further moving along the eject direction. Thus, the connection state between the connector 10 and the FPC 800 is locked (maintained).

Moreover, according to the embodiment, the lock portion 270 (the spring portion 272) is positioned rearward of the coupling portion 256. When the FPC 800 positioned at the connection state is moved along the eject direction by force, the spring portion 272 is displacing forward (in the −X direction), and the projection portion 274 is brought into contact with the coupling portion 256. The coupling portion 256 prevents an excessive displacement (movement) of the spring portion 272 toward the eject direction. In the embodiment, the lock portion 270 can be strengthened, and damage of the lock portion 270 is prevented. Moreover, the attachment 250 is formed integrally with the shell 200 so that force exerted to the FPC 800 along the −X direction can be received by the whole part of the attachment 250 (the whole part of the shell 200 fixed on the circuit board 900). Therefore, the connection state between the connector 10 and the FPC 800 is securely maintained and the damage of the lock portion 270 is prevented.

As shown in FIG. 10 and FIG. 11, the insertion opening 12 opens forward and upward (in the −X direction and the +Z direction). In detail, a part of the bottom portion 116 and the guide portion 220 is visible when seen along the Z direction. Therefore, the FPC 800 can be easily inserted into the connector 10 obliquely (see FIG. 12).

Figure 5:
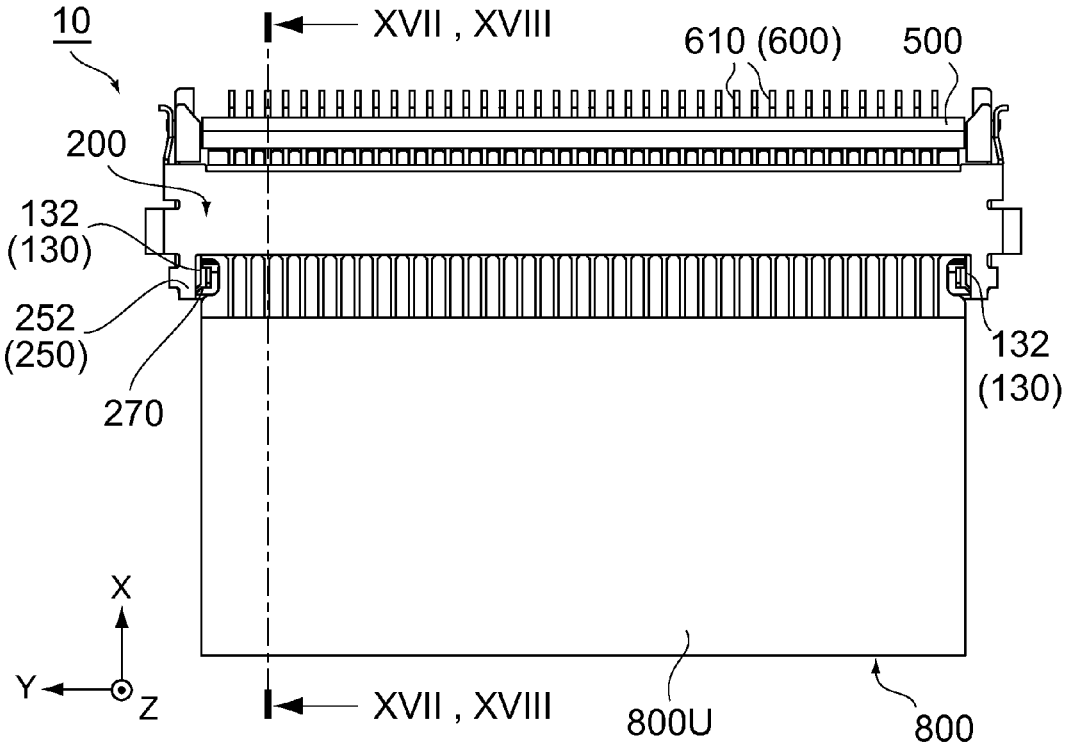
FIG. 5 is a plan view showing the connector of FIG. 1. The FPC is inserted to the connector. An actuator is positioned at an open position.

As shown in FIG. 4, FIG. 5 and FIG. 12, the locking lug 276 is visible along the Z direction. Therefore, the connection state between the connector 10 and FPC 800 is visible from above the connector 10. The connection between the FPC 800 and the connector 10 is released by pushing the locking lug 276 down.

The mount object of the embodiment is the circuit board. However, the mount object is not limited thereto. The present invention can be applied to a connector which is not mounted on the circuit board.

The connection object is not limited to the sheet-like connection object such as FPC or FFC (Flexible Flat Cable). When the connection object is thick, the locked portion of the connection object may be a recess.

Moreover, the hold down, the guide portion, the ground spring portion, and the ground portion may be separated from each other.

The present application is based on a Japanese patent application of JP2011-259404 filed before the Japan Patent Office on Nov. 28, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable with a connection object having a locked portion, the connection object being insertable into the connector from a front of the connector in an insertion direction, and the locked portion having an engaged portion, the connector comprising:

a housing;

an attachment attached to the housing, wherein the attachment comprises an upper attachment, a lower attachment, and a coupling portion, the upper attachment is positioned above the housing, the lower attachment is positioned below the housing, and the coupling portion couples the upper attachment and the lower attachment; and a lock portion comprising a locking lug and a spring portion, wherein the locking lug is positioned rearward of the coupling portion in the insertion direction, the locking lug has an engagement portion, the spring portion is positioned between the upper attachment and the lower attachment, and the spring portion supports the locking lug such that the locking lug is displaceable in a vertical direction perpendicular to the insertion direction;

wherein when the connection object is connected with the connector and moved in an eject direction that is opposite to the insertion direction, the engagement portion engages with the engaged portion such that the engagement portion prevents the engaged portion from further moving along the eject direction.

2. The connector according to claim 1, wherein the housing is provided with an arm which guides the connection object when the connection object is inserted into the connector, the arm extends in the eject direction, and the spring portion is positioned between the arm and the lower attachment in the vertical direction.

3. The connector according to claim 1, wherein the spring portion is formed with a projection portion projecting toward the coupling portion.

4. The connector according to claim 1, further comprising a shell held by the housing, wherein the attachment is a part of the shell, and the upper attachment covers an upper surface of the housing.

5. The connector according to claim 1, wherein the attachment and the lock portion are formed integrally with each other.

6. The connector according to claim 5, wherein the spring portion extends from the upper attachment.

7. The connector according to claim 4, wherein the housing is formed with a press-fitted portion, and the shell comprises a press-fit portion and is attached to the housing by press-fitting the press-fit portion into the press-fitted portion.

8. The connector according to claim 1, wherein the connection object has a sheet-like shape; and wherein the connector further comprises:

an insertion opening into which the connection object is insertable, the insertion opening extending in a width direction perpendicular to the insertion direction and the vertical direction; and a guide portion positioned in front of the insertion opening and extending in the width direction, the guide portion guiding the connection object when the connection object is inserted into the connector.

9. The connector according to claim 8, further comprising a ground spring portion positioned at a bottom part of the insertion opening and being displaceable in the vertical direction, wherein at least a part of the ground spring portion is positioned above the guide portion.

10. The connector according to claim 1, wherein the connector is mounted on a mount object and further comprises a ground portion connected with the mount object.

11. The connector according to claim 1, wherein the locking lug is arranged so as to be visible when seen along the vertical direction.

* * * * *